US006076282A

United States Patent [19]

Brue'

[11] Patent Number: 6,076,282

[45] Date of Patent: Jun. 20, 2000

[54] SHOE SOLE WITH FORCED AIR CIRCULATION SYSTEM

[75] Inventor: Aldo Brue' , Monte S. Pietrangeli, Italy

[73] Assignee: Brue' S.p.A., Monte S. Pietrangeli, Italy

[21] Appl. No.: 09/194,222

[22] PCT Filed: May 21, 1997

[86] PCT No.: PCT/EP97/02725

§ 371 Date: Nov. 20, 1998

§ 102(e) Date: Nov. 20, 1998

[87] PCT Pub. No.: WO97/43918

PCT Pub. Date: Nov. 27, 1997

[30] Foreign Application Priority Data

May 22, 1996 [IT] Italy ..... MI96A1027

[51] Int. Cl.[7] ..... A43B 7/06

[52] U.S. Cl. ..... 36/3 B; 36/29; 36/141; 36/153

[58] Field of Search ..... 36/141, 3 R, 3 B, 36/29, 153

[56] References Cited

U.S. PATENT DOCUMENTS

| | | | |
|---|---|---|---|
| 4,047,310 | 9/1977 | Sundo | 36/141 X |
| 4,223,455 | 9/1980 | Vermeulen | 36/3 B X |
| 4,499,672 | 2/1985 | Kim | 36/3 B |
| 5,467,536 | 11/1995 | Ramer et al. | 36/3 B X |
| 5,537,762 | 7/1996 | Walters | 36/3 B X |
| 5,619,809 | 4/1997 | Sessa | 36/3 B X |
| 5,655,314 | 8/1997 | Petracci | 36/3 B |
| 5,809,665 | 9/1998 | Suenaga | 36/3 B X |

FOREIGN PATENT DOCUMENTS

| | | | |
|---|---|---|---|
| 474016 | 2/1928 | Germany | 36/3 B |

*Primary Examiner*—Paul T. Sewell
*Assistant Examiner*—J. Mohandesi
*Attorney, Agent, or Firm*—Young & Thompson

[57] ABSTRACT

A forced-ventilation shoe includes a midsole or insole provided with a plurality of through-holes, resilient support means arranged between the outsole and the midsole or insole to form an air chamber between the elements, and devices for occluding the holes, apt to close off individually the holes themselves during pressing of the foot on the insole, where the occluding devices may include a plurality of reliefs projecting from the upper surface of the outsole and matching the holes.

20 Claims, 2 Drawing Sheets

SHOE SOLE WITH FORCED AIR CIRCULATION SYSTEM

BACKGROUND OF THE INVENTION

The present invention relates to a forced-ventilation shoe and in particular to a shoe of this type in which there are provided improved means for controlling the flow of air inside the shoe itself, in the interface zone between the internal part of the shoe and the air-chamber for collecting and pumping the contaminated air.

DESCRIPTION OF THE RELATED ART

During recent years a great deal of interest has been generated by a new type of shoe which has been introduced onto the market, i.e. a so-called ventilated shoe in which ventilation of the foot is no longer ensured only by the intrinsic breathability of the material which forms the sole or the upper or general ventilation of the shoe obtained by means of varyingly arranged ventilation holes, but instead is provided by a true pumping system which, by exploiting via different techniques the compressive work performed by the foot during the walking movement, transfers the contaminated air from the inside to the outside of the shoe, re-introducing fresh air via the neck or other openings in the shoe itself.

This new type of shoe was initially first introduced in connection with shoes used for sports activities. These shoes, in fact, are often made with low-permeability materials and therefore give rise to considerable problems of breathability which are made worse by the increased sweating of the foot during the sporting activity. In the ventilation system used by these sports shoes, compressible chambers are formed in the thickness of the sole, in the heel or sole zone of the shoe, said chambers acting as a lung for sucking in and expelling the contaminated air from inside the shoe, by exploiting the mechanical energy of the foot during the walking movement. The lung is in fact alternately compressed and released during the respective pressing and lifting movements of the shoe onto/from the ground, thus resulting in suction of air from inside the shoe and emission thereof outside through special channels or holes formed in the shoe.

Forced ventilation systems of this type are for example disclosed in U.S. Pat. No. 4,860,463, GB-A-2,247,391, U.S. Pat. No. 4,438,573 and U.S. Pat. No. 4,654,982. These forced-ventilation systems also envisage the use of one-way valves inserted in the aforementioned channels or holes, so as to allow a single direction for the air flow, and in particular from the inside to the outside of the shoe. The presence of the compressible lung also has the effect of cushioning the impacts to which the shoe itself is subject during the sporting activity, while ensuring maximum comfort of the foot.

The same Applicant has already proposed the application of a ventilation system for footwear also to classic rigid-sole shoes for daily use, in which the introduction of compressible elements for the formation of the lung is not desirable. The cushioning effect which the lung inevitably has is not liked at all by users of this type of shoe since it provides the walking movement with an excessively "springy" action which is not suitable for formal work or social situations.

Italian Utility Model No. 222,150 discloses precisely an innovative system for the ventilation of shoes, where in the front part of the shoe, more precisely between the outsole and insole, there is formed a spacious chamber for collecting the contaminated air, communicating with the inside of the shoe by means of a plurality of holes, said chamber being formed by elements which are rigid and, at least partly, flexible. An air chamber thus formed offers a rigid and stable support for the foot, which is entirely similar to that of traditional shoes and at the same time is able to vary its own volume during the final part of the step and the consequent accentuated bending of the front part of the shoe, obtaining the desired pumping effect without the insertion of compressible elements in the sole structure.

In order to obtain the maximum pumping efficiency and avoid also a partial backflow of air from the collecting chamber to the inside of the shoe, when the foot presses on the said chamber, in addition to the presence of the one-way breather valve which prevents the return of outside air or in any case reversal of the direction of flow of the air inside the shoe, the above utility model also discloses the use of an insole which is perforated and allows airing only in the top-to-bottom direction.

The insoles of this type which are known hitherto may be divided up into two categories, each of which, however, has drawbacks. A first category comprises insoles (or inner soles resting on the insole) provided with a large number of small-diameter holes having a configuration so as to facilitate flow of the air in the direction passing from the top towards the bottom and such that they may be easily closed by the foot—owing also to a suitable arrangement thereof—during the pressure of the foot on the sole. This category of insoles has a good performance in terms of uniformity of operation, but not a high level of efficiency on account of the necessarily small dimensions of the holes and the fact that in any case a portion of the air which has collected inside the air chamber formed into the outsole is forced back inside the shoe during pressure of the foot on the chamber itself. A second category comprises, on the other hand, insoles with a small number of holes, often only one, each of which is provided with a suitable non-return valve. These insoles have the drawback of a higher manufacturing cost and moreover a poor level of efficiency, since the air is sucked in at localised points and homogeneous ventilation is not created over the entire sole of the foot.

SUMMARY OF THE INVENTION

An object of the present model is providing a forced-ventilation shoe of the type described above, in which the air flow entering the collecting chamber or the lung is perfectly controlled over the entire extent of the chamber itself, avoiding any undesirable return of contaminated air from the collecting chamber to the inside of the shoe during the pressing action of the foot.

The present invention therefore aims to provide a new forced-ventilation shoe which is able to ensure in an efficient manner the passage of a large quantity of air exclusively in the desired direction, so as to exploit fully the pumping energy arising from the walking movement and produce a good ventilation effect even when there is a limited motory activity, as frequently occurs with the use of town shoes.

The objects described above are achieved according to the present invention by a forced-ventilation shoe comprising a midsole or insole provided with a plurality of through-holes, resilient support means arranged between the midsole or insole and the outsole, apt to form an air chamber between said elements, and means for occluding said holes, apt to close off individually the holes themselves during pressing of the foot on the midsole or insole.

In a first embodiment, intended to be used with shoes having a conventional insole structure, the through-holes which can be occluded are formed in a cushion midsole housed in a special cavity of the outsole. The structure formed by the assembly consisting of the outsole and midsole is associated with the assembly consisting of the upper and corresponding insole by means of conventional systems involving bonding or stitching. The conventional insole is suitably perforated, in the region of the cushion midsole, so as to allow the passage of the contaminated air from inside the shoe to the air chamber.

The invention also envisages a second, particularly innovative embodiment in which it is the same insole which is provided with the occludable through-holes. In this case the insole is made from a plastic material and also forms the lateral edge of the sole, so as to ensure both correct and immediate centring of the through-holes with the occluding means and an optimum aesthetic finish.

BRIEF DESCRIPTION OF THE DRAWINGS

Further characteristic features and advantages of the present invention will nevertheless emerge more clearly from the detailed description which follows of a preferred embodiment of thereof, provided with reference to the accompanying drawings, wherein.

DESCRIPTION OF THE PREFERRED EMBODIMENTS

As can be clearly seen from an overall examination of the drawings, the forced-ventilation shoe according to the present invention comprises a combination of elements for forming the outsole and in case the insole of the shoe, designed to be matching so as to provide a series of openings which can be alternately closed or opened depending on whether or not the foot is pressed on the insole, during the walking movement.

More particularly, this result is obtained by constructing the cushion midsole of the first embodiment or the insole of the second embodiment with a series of holes uniformly distributed thereon and by constructing the underlying outsole with a plurality of reliefs having an arrangement matching that of said holes and designed to be inserted therein, occluding them, when the cushion midsole or the insole are deformed by the user's weight or by bending of the shoe during the walking movement. Between the outsole and midsole or between the outsole and insole there is also provided a plurality of resilient supports which may be formed indifferently in the sole or in the midsole or insole and which enable an air chamber with a variable volume to be formed and maintained between said elements. The. compressibility of said resilient supports is preselected in accordance with the type of shoe; thus, for sports shoes softer supports will be used, being able to be resiliently deformed already during the initial part of the step and therefore providing a shock-absorbing effect for the foot against impacts to which it is exposed during the sporting activity; on the other hand, in town shoes more rigid resilient supports will be used, such that deformation of the midsole or the insole does not occur during the initial pressing action of the foot, but only during the end part of the step, owing to the accentuated bending of the shoe.

Figure 2:
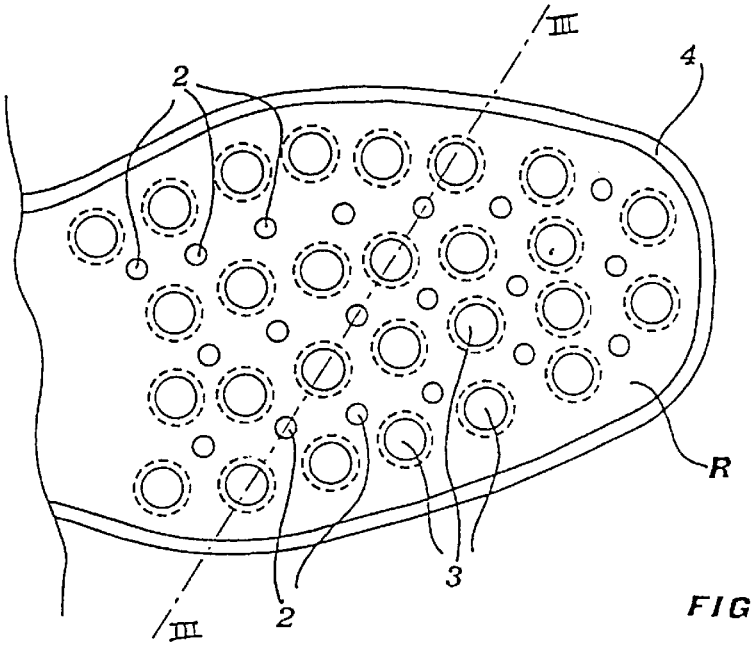
FIG. 2 is a plan view of a cushion midsole to be inserted in the outsole according to FIG. 1.
Figure 1:
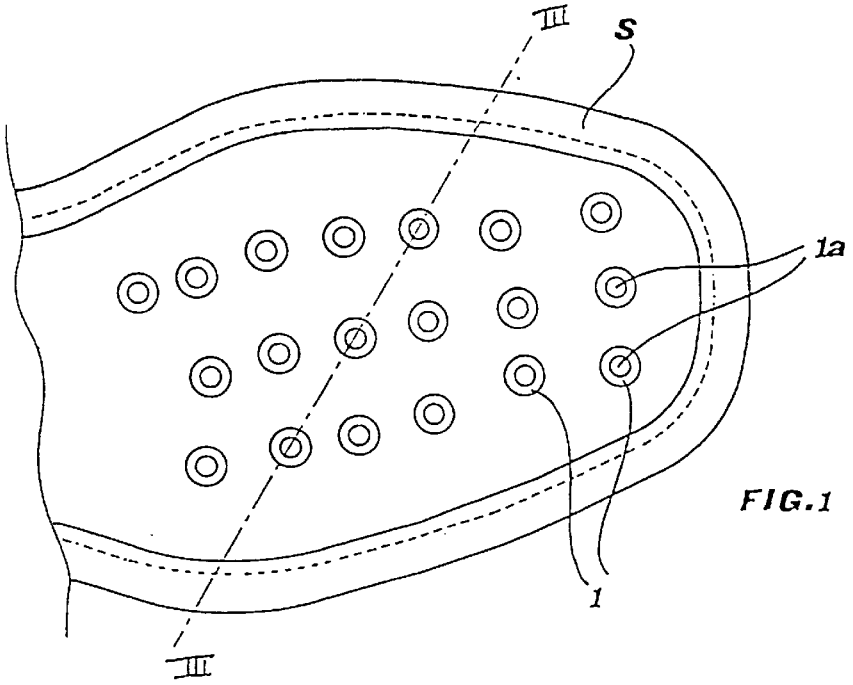
FIG. 1 is a plan view of the front part of an outsole according to a first embodiment of the forced-ventilation shoe according to present invention.
Figure 3:
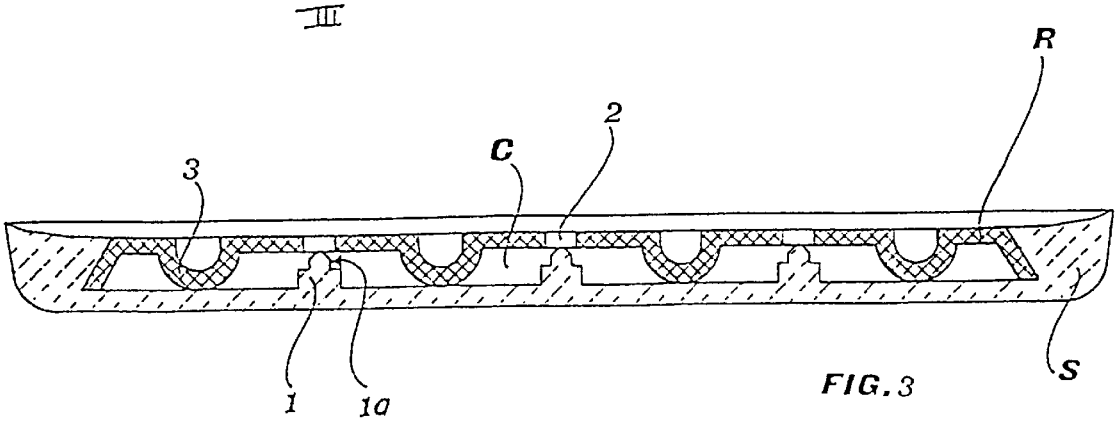
FIG. 3 is cross-sectional view of the assembled unit consisting of the outsole and midsole illustrated in FIGS. 1 and 2, along the lines III—III of said figures.
Figure 5:
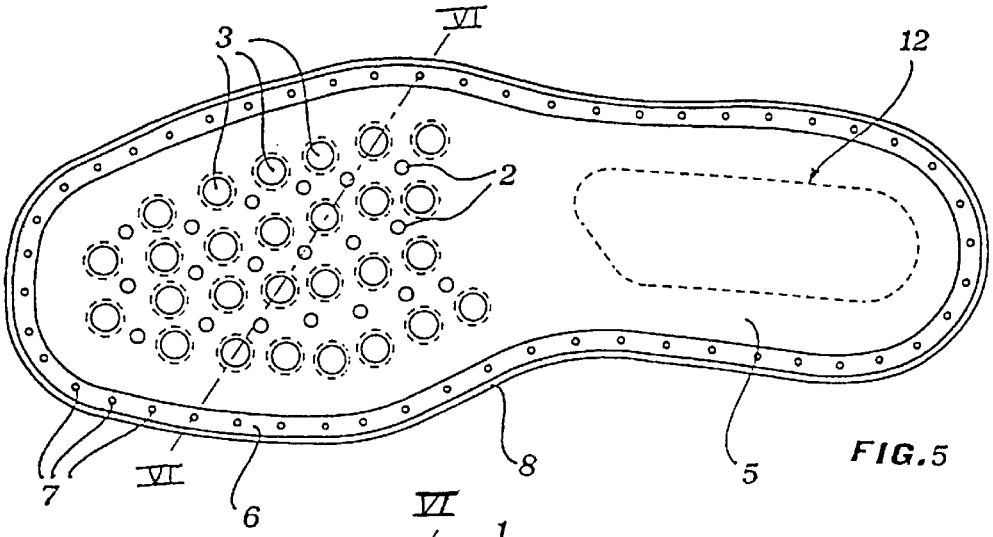
FIG. 5 is a plan view of an insole to be combined with the outsole according to FIG. 4.
Figure 4:
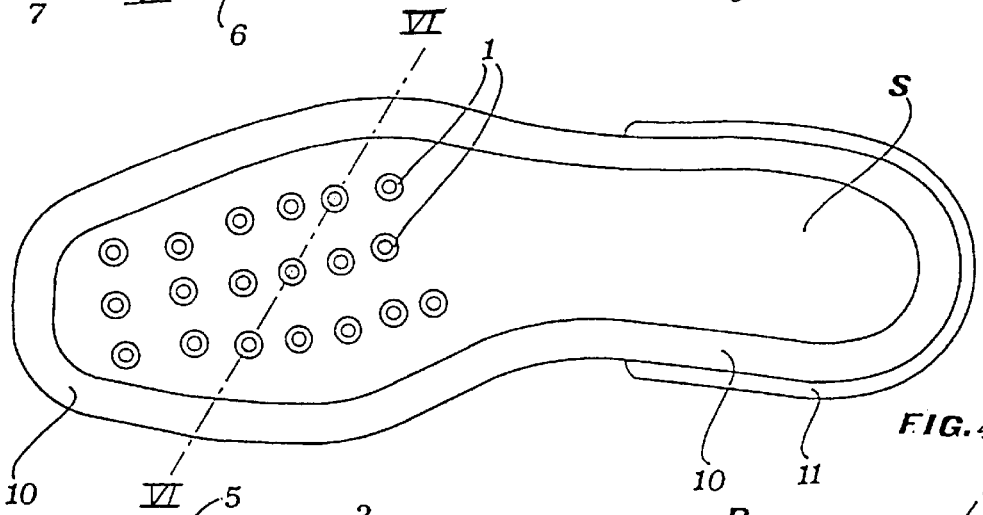
FIG. 4 is a plan view of the outsole of a second embodiment of the forced-ventilation shoe according to the present invention.

In the first embodiment shown in FIGS. 1, 2 and 3, the outsole is indicated by the reference S and the cushion midsole by the reference R. Cylindrical reliefs 1 project upwards from the outsole S, while the midsole R has a matching plurality of holes 2, constructed so that when the midsole R is mounted on the outsole S (see FIG. 3) the holes 2 are superimposed exactly on the reliefs 1. The dimensions of the reliefs 1 and the holes 2 are designed so that the diameter of the base of the reliefs 1 is greater than the diameter of the holes 2 and this base therefore acts as support and occluding means of the holes themselves when the midsole is deformed downwards on account of the load applied by the foot or the accentuated bending of the shoe, and so that the height of the base of the reliefs 1 is less than the height of the air chamber C (distance between the internal walls of the outsole S and the midsole R) so as to allow a good air flow through the holes 2 when the cushion midsole R is not deformed.

At the top of the reliefs 1 there is preferably provided a small cilynder-conical protuberance 1*a* with a rounded tip, having a maximum diameter slightly less than the diameter of the holes 2 and height approximately equal to the thickness of the midsole R, such that during the pressing action of the foot this protuberance 1*a* gradually "occupies" the empty space of the holes 2, causing perfect centering of the holes 2 on the reliefs 1 during any walking conditions and also providing a continuous support for the foot. The overall height of the reliefs 1, in this case, is preferably approximately equal to the height of the air chamber C.

The midsole R and the outsole S must obviously be fastened together at their boundaries so as to create a good air seal, even in the absence of a sealant which sometimes may not be desirable. In the embodiment shown in the drawings, this result is obtained by forming the midsole with an inclined peripheral edge 4 and the outsole with a matching edge having a similar inclination, as is clearly visible in FIG. 3. This type of joint between midsole R and outsole S is per se able to provide a satisfactory air seal during compression of the chamber C by the foot, but obviously this seal may be further improved with the use of sealants or bonding agents arranged along the edge 4.

In the second embodiment shown in FIGS. 4, 5, 6 and 7, the outsole is indicated by the letter S, while the insole is indicated by the letter P. With this different embodiment it is possible to obtain a simple and compact structure of the shoe—of the type wherein the upper is fixed to the insole through an external stitching—which, in addition to achieving the main result of optimum forced ventilation, also enables numerous additional advantages to be attained.

Figure 6:
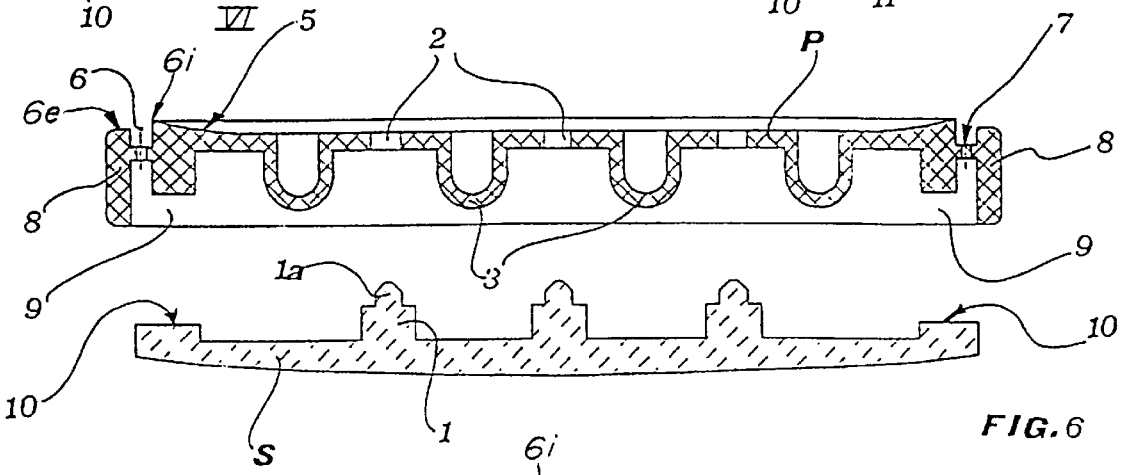
FIG. 6 is an exploded cross-sectional view of the unit consisting of the outsole and insole illustrated in FIGS. 4 and 5, in the assembly position, along the lines VI—VI of said figures.
Figure 7:
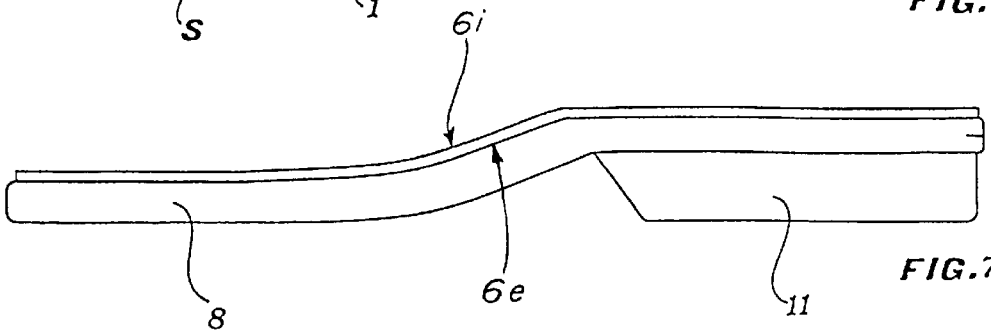
FIG. 7 is a side view of the outsole and insole illustrated in FIGS. 4 and 5, in the assembled position.

As can be clearly seen in the cross-section shown in FIG. 6 and FIG. 7, the insole P (FIG. 5), moulded from a suitable plastic material, has a fairly complex structure comprising in particular: an upper flat surface 5, shaped in the form of the foot-sole; a peripheral groove 6, on the bottom of which vertical through-holes 7 for stitching the upper (not shown) to the insole P are formed; a peripheral edge 8, which forms the external edge of the shoe sole; a seat 9 for housing the outsole S, said seat extending along the entire lower perimeter of the insole P; an insert of rigid plastic material 12 in the rear zone; in addition, obviously, to through-holes 2 formed in the surface 5 and resilient supports 3 projecting downwards therefrom. The arrangement and the function of the holes 2 and the resilient supports 3 is exactly the same as that of the corresponding elements already described in relation to the first embodiment of the present invention and will therefore not be discussed here further.

The outsole S (FIG. 4) is also moulded from a suitable plastic material and has a raised peripheral edge 10 which fits to the aforementioned seat 9 of the insole P, where it is fixed with a suitable bonding agent. The outsole S comprises at the rear a wider portion which forms the heel 11 of the shoe. Alternatively, the structure of the heel 11 may be associated with the insole P. When the edge 10 of the outsole S is fixed into the respective seat 9 of the insole P, the external surface of the outsole S is perfectly aligned with the bottom surface of the external peripheral edge 8 of the insole P, thus forming a shoe which is extremely robust and devoid of unaesthetic joining lines between insole and outsole, as is clearly visible in the side view of FIG. 7.

The internal surface of the outsole S also has, projecting from it upwards, cylindrical reliefs 1 with a cilynder-conical central protuberance having a rounded tip, entirely similar to those already illustrated in connection with the first embodiment of the present invention and therefore intended to cooperate with the holes 2 of the insole P. As a result of the precise fit between the outsole S and the insole P, resulting from joining together of the edge 10 and the seat 9, extremely precise engagement between each hole 2 and the respective relief 1 may be obtained, thus ensuring excellent performance of the forced-ventilation shoe according to the present invention.

Owing to the particular structure of the insole/outsole described above it is possible to obtain other important results, in addition to ensuring highly efficient forced ventilation of the shoe, such as, in particular, that of obtaining a shoe which is particular strong and dry. In fact, it should be noted above all that the upper is directly stitched to the insole P and this last is the only part of the outsole which, during walking, may interfere with any obstacles, since its external edge 8 completely surrounds the outsole S. Any knocking of the shoe (i.e. of the edge 8 of the insole P) against an obstacle and the consequent stress imparted to the upper of the foot are therefore directly transmitted to the upper/insole stitching (which is very strong) and not to the bonded insole/outsole joint. It is so possible to entirely avoid any accidental separation of the bonded joint between insole and outsole, which sometime occurs in shoes with a conventional insole glued to the outsole, after a certain period of use, in particular in conditions of frequent wetting of the shoe. For the same reason, namely owing to the fact that it is completely set inside the insole P, the outsole S is not subject to any pulling stresses, in addition to the normal friction due to the walking movement and consequently the bonded joint between outsole S and insole P is never stressed excessively.

Since stitching of the upper to the insole P is performed in the region of the groove 6, the upper is folded and forced into this groove inside which it is entirely housed and tighltly clamped so as to render it fairly difficult for water to pass from outside to inside the shoe in this joining zone which—expecially for this kind of shoes with external stitching of the upper—is frequently a critical zone from this point of view.

Finally, there are two other particular features of the shoe according to the present invention which it is worth emphasizing. The first one, already implicit in the preceding description of the methods for joining together the outsole S and the insole P, is that the outsole S completely seals the holes 7 from the bottom, protecting the stitching both from water infiltration and wear—two conditions which both occur in conventional shoes which have the upper stitched to the outsole. The second feature is that the internal edge 6i of the groove 6 is always higher than the external edge 6e of said groove, as can be clearly seen in FIGS. 6 and 7, such that any moisture which might in case penetrate into the groove 6 cannot in any case enter inside the shoe. It is obvious therefore that the shoe according to the second embodiment of the present invention, in addition to the advantage of being perfectly ventilated, has the advantage that it is very strong and particularly dry even in very wet environmental conditions of use.

In the two embodiments above illustrated, the resilient supports between the outsole S and the midsole R or the insole T are formed as one piece with the midsole R or the insole P; they could alternately be associated with the outsole S or form part of a separate intermediate element. The resilient supports 3 are arranged at intervals between the holes 2 so as to provide a continuous and soft support for the foot, despite the presence of the reliefs 1 projecting from the upper surface of the outsole S, and so as to form at the same time an air chamber C between the midsole R or the insole P and outsole S, having the desired volume. The resilient supports 3 may be in the form of hollow semi-spheres shown in the drawings; other forms, however, may be equally functional, depending on the type of shoe. If, for example, it is wished to provide the supports 3 with a greater degree of compressibility, the hollow semi-spheres may be modified by forming in them one or more annular grooves which facilitate compression thereof. On the other hand, said semi-spheres may be provided with stiffening ribs should it be wished to increase their rigidity. Should one wish instead to provide the resilient supports with a particular bending capacity—so as to increase the deformability of the midsole R or the insole T during the end part of the step when the shoe is greatly flexed—they may advantageously be in the form of rectangular or cylindrical bars, preferably inclined, projecting from the surface of the midsole or the insole; in the case where the bars are inclined—a condition which favours bending—it will be advantageous if they are arranged in parallel rows with opposing inclinations, so as to prevent the midsole R or the insole P from undergoing displacements during flexing of the bars. The degree and the orientation of the inclination of said bars, as well as the level of compressibility of the material forming the resilient supports 3, may be preselected in accordance with the springing action which the shoe is to be provided with.

The object of the forced-ventilation shoe according to the present invention is, as already stated, to provide first of all a collecting chamber C for the contaminated air which forms inside the shoe and secondly a lung for expelling the air outside the shoe itself, using any one of the systems known in the art for this purpose and discussed in the introductory part of the present description. This object is achieved in the manner explained below.

During pressing of the foot on the insole, which occurs naturally at the same time as pressing of the shoe on the ground, the midsole R or the insole P undergo initial deformation during which the midsole or the insole itself, or more precisely the edge of the holes 2, comes into contact with the upper surface of the base of the reliefs 1, along an annular strip having a height equal to half the difference between the diameter of the base of the reliefs 1 and that of the holes 2. A perfectly sealed chamber for collecting the contaminated air C is thus formed, therefore being suitable for functioning as a lung for compression towards the external outlet connected to said chamber—preferably provided, in a per se known manner, with a non-return valve—when the pressure of the foot on the midsole R or on the insole P further increases during the end part of the step and/or when the volume of the chamber C is further reduced owing to the accentuated bending action which is imparted to the front part of the shoe.

At the end of the step, therefore, the chamber C has a volume which is somewhat smaller than that of its rest position, having discharged externally part of the contaminated air collected therein. As soon as the foot is lifted from the ground, the midsole R or the insole P return, owing to the elasticity of the material from which they are made, into the rest position, freeing the holes 2 from the reliefs 1. The chamber C therefore resumes its original volume, creating internally a certain vacuum as a result of which an additional quantity of contaminated air is immediately sucked in from inside the shoe, through the holes 2 which have just re-opened. During repetition of this cycle there is therefore a continuous displacement of air from inside the shoe through the midsole R or the insole P to outside of the shoe itself (via any known system of ducts with one-way valves, which are per se known and therefore not illustrated), without any "backflow" of air from the chamber C into the shoe, a backflow which always occurs instead—to a greater or lesser extent—in ventilated shoes of the known type. The object of the invention, namely that of providing a forced-ventilation shoe in which the air flow has effectively only one direction, is therefore fully achieved.

In the description above and in the drawings exclusive reference has been made to a forced-ventilation system provided in the front part of the shoe. It is entirely obvious that a system such as that illustrated may be provided in any zone of the shoe where alternating pressing of the foot occurs—and hence also for example in the heel zone by suitably adapting the form and operation of the system for discharging the contaminated air collected inside the chamber C and pumped therefrom towards the outside. However, the arrangement in the front part of the shoe is preferred, since in this zone much wider variations in the volume of the chamber C occur at each step, for the reasons already examined above.

It is equally obvious that the invention must not be understood as being limited to the particular form and arrangement with which the reliefs 1, the holes 2 and the resilient supports 3 have been provided, it being possible for them to be varied to a far greater extent with respect to that shown in the drawings, as moreover has already been stated above, without thereby departing from the scope of the invention, as defined in the claims indicated below. By way of example, the occluding reliefs 1 instead of being formed with the outsole may be formed directly with the midsole R or the insole P; in this case they will preferably be made of the same resilient material which forms the midsole R or the insole P and will have the form of simple cylinders with axial holes, having a height such that they are separated from the outsole S, during rest conditions, by a sufficient amount to ensure a good flow of air through the holes 2.

I claim:

1. Forced-ventilation shoe, of the type comprising an air chamber formed between a midsole or insole provided with a plurality of through-holes and an outsole, and a resilient support means arranged inside said air chamber so as to form the same in a desired, variable, volume and preselected softness, said air chamber being connected with an ambient through means apt to prevent any backflow of ambient air from the outside to the inside of said air chamber, characterized in that the shoe further comprises a means for occluding said holes, apt to close off individually the holes themselves during pressing of a foot on the midsole or insole.

2. Forced-ventilation shoe as claimed in claim 1, wherein said midsole is in the form of a cushion of resilient plastic material with controlled compressibility and is housed in a corresponding cavity of the outsole.

3. Forced-ventilation shoe as claimed in claim 1, wherein said insole is made from a resilient plastic material with controlled compressibility and comprises an upper surface shaped in the form of a foot sole, an upper peripheral groove having formed on a bottom thereof through-holes for a stitching of an upper, a peripheral edge which forms an external edge of a shoe sole, and a lower peripheral seat for housing the outsole.

4. Forced-ventilation shoe as claimed in claim 3, wherein said through-holes for the stitching of the upper open out underneath, in a region of said lower peripheral seat for housing the outsole.

5. Forced-ventilation shoe as claimed in claim 3, wherein at least part of said outsole, in an assembled position, is completely set inside said lower peripheral seat of said insole.

6. Forced-ventilation shoe as claimed in claim 3, wherein an internal edge of said upper peripheral groove is higher than the external edge thereof.

7. Forced-ventilation shoe as claimed in claim 1, wherein said resilient support means is formed as one piece with the midsole or with the insole.

8. Forced-ventilation shoe as claimed in claim 7, wherein said resilient support means is in the form of hollow semi-spheres projecting from a bottom surface of said midsole or insole.

9. Forced-ventilation shoe as claimed in claim 8, wherein said hollow semi-spheres have one or more annular grooves.

10. Forced-ventilation shoe as claimed in claim 7, wherein said resilient support means is in the form of rectangular or cylindrical bars projecting from the bottom surface of said midsole or insole.

11. Forced-ventilation shoe as claimed in claim 10, wherein said inclined bars are arranged in alternate rows with opposing inclinations.

12. Forced-ventilation shoe as claimed in claim 1, wherein said occluding means comprises a plurality of reliefs projecting from an upper surface of the outsole opposite and matching the holes of the midsole or insole.

13. Forced-ventilation shoe as claimed in claim 12, wherein said reliefs consist of cylinders having a diameter greater than a diameter of said holes.

14. Forced-ventilation shoe as claimed in claim 13, wherein said cylinders end at a top in a cylinder-conical protuberance with a rounded tip, having a maximum diameter slightly less than the diameter of said holes and a height approximately equal to a thickness of said midsole or insole.

15. Forced-ventilation shoe as claimed in claim 1, wherein said occluding means comprises a plurality of compressible reliefs with axial holes, projecting from a bottom surface of the midsole or insole, in correspondence of the holes thereof.

16. Forced ventilation shoe as claimed in claim 12, wherein a height of said reliefs is less than a height of said air chamber.

17. Forced-ventilation shoe as claimed in claim 14, wherein the height of said cylinders, including said protuberance, is approximately equal to a height of said air chamber.

18. Forced-ventilation shoe as claimed in claim 1, wherein air-sealing means is provided along a joining edge of a sole to the midsole or insole.

19. Forced-ventilation shoe as claimed in claim 18, wherein said air sealing means comprises a joint with inclined matching edges between the outsole and the midsole.

20. Forced-ventilation shoe as claimed in claim 18, wherein said air-sealing means comprises a joint between the outsole and the midsole or insole fixed by a sealant or bonding agent.

* * * * *